US010102983B2

(12) United States Patent
Steininger et al.

(10) Patent No.: US 10,102,983 B2
(45) Date of Patent: Oct. 16, 2018

(54) INTERMODULATION-FREE ELECTRICAL CONTACT FOR HF APPLICATIONS

(71) Applicant: Kathrein Werke KG, Rosenheim (DE)

(72) Inventors: Christian Steininger, Rosenheim (DE); Thomas Haunberger, Rosenheim (DE)

(73) Assignee: Kathrein Werke KG, Rosenheim (DE)

( * ) Notice: Subject to any disclaimer, the term of this patent is extended or adjusted under 35 U.S.C. 154(b) by 30 days.

(21) Appl. No.: 15/292,618

(22) Filed: Oct. 13, 2016

(65) Prior Publication Data

US 2017/0110262 A1 Apr. 20, 2017

(30) Foreign Application Priority Data

Oct. 16, 2015 (DE) ..... 10 2015 117 687

(51) Int. Cl.

| | |
|---|---|
| ***H01R 39/00*** | (2006.01) |
| ***H01H 1/06*** | (2006.01) |
| ***H01H 1/14*** | (2006.01) |
| ***H01H 89/00*** | (2006.01) |
| ***H01R 13/631*** | (2006.01) |
| *H01R 13/621* | (2006.01) |
| *H01R 24/52* | (2011.01) |
| *H01Q 19/10* | (2006.01) |

(52) U.S. Cl.

CPC ..... *H01H 1/06* (2013.01); *H01H 1/14* (2013.01); *H01H 89/00* (2013.01); *H01R 13/6315* (2013.01); *H01Q 19/108* (2013.01); *H01R 13/6215* (2013.01); *H01R 24/52* (2013.01); *H01R 2201/02* (2013.01)

(58) Field of Classification Search

CPC .... H01R 13/6215; H01R 12/00; H01R 24/52; H05K 3/36; H01H 1/06; H01H 1/14

USPC ..... 439/66, 1

See application file for complete search history.

(56) References Cited

U.S. PATENT DOCUMENTS

| | | | | |
|---|---|---|---|---|
| 7,621,755 | B2 * | 11/2009 | Kubo | H01R 13/2435 439/66 |
| 2004/0166715 | A1 | 8/2004 | Parrish et al. | |
| 2008/0252552 | A1 | 10/2008 | Goebel | |

(Continued)

FOREIGN PATENT DOCUMENTS

| | | |
|---|---|---|
| CN | 103458119 | 12/2013 |
| DE | 1125496 | 3/1962 |
| DE | 10 2011 122 037 A | 6/2013 |

*Primary Examiner* — Abdullah Riyami
*Assistant Examiner* — Nader Alhawamdeh
(74) *Attorney, Agent, or Firm* — Fish IP Law, LLP

(57) ABSTRACT

What is provided is an arrangement for electrically contacting electrically conductive elements, comprising a first element, at least a portion of which is electrically conductive, at least one second element, at least a portion of which is electrically conductive, for electrically contacting the first element, comprising a contact area in at least one end region thereof, the contact area having a radius at least at predefined contact points. The first electrically conductive element has at least one area that is designed to receive at least a portion of the contact area of the second electrically conductive element such that an electrical contact is created between the first electrically conductive element and the contact points of the second electrically conductive element. Furthermore, a corresponding first and second element is provided.

10 Claims, 3 Drawing Sheets

(56) References Cited

U.S. PATENT DOCUMENTS

| | | | | |
|---|---|---|---|---|
| 2011/0039424 | A1* | 2/2011 | Di Stefano | H01R 4/027 439/66 |
| 2011/0059631 | A1* | 3/2011 | Tamura | H01R 12/7082 439/66 |
| 2012/0146876 | A1 | 6/2012 | Yang | |
| 2013/0313726 | A1* | 11/2013 | Uehling | H01L 21/563 257/777 |
| 2013/0322021 | A1 | 12/2013 | Ohoka | |
| 2015/0001725 | A1* | 1/2015 | Hu | H01L 25/50 257/762 |
| 2017/0110262 | A1* | 4/2017 | Steininger | H01H 1/06 |

* cited by examiner

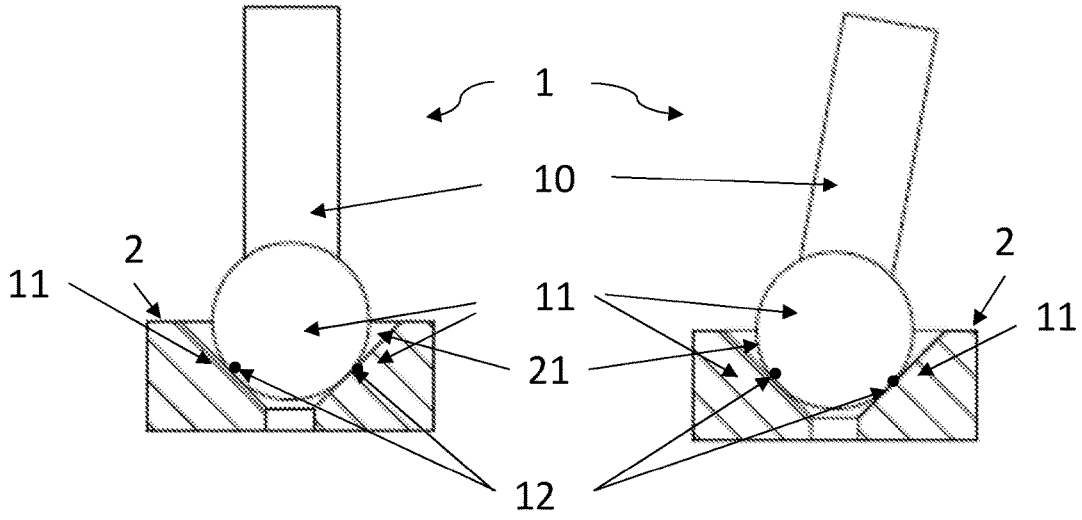
Fig. 1a
Fig. 1b
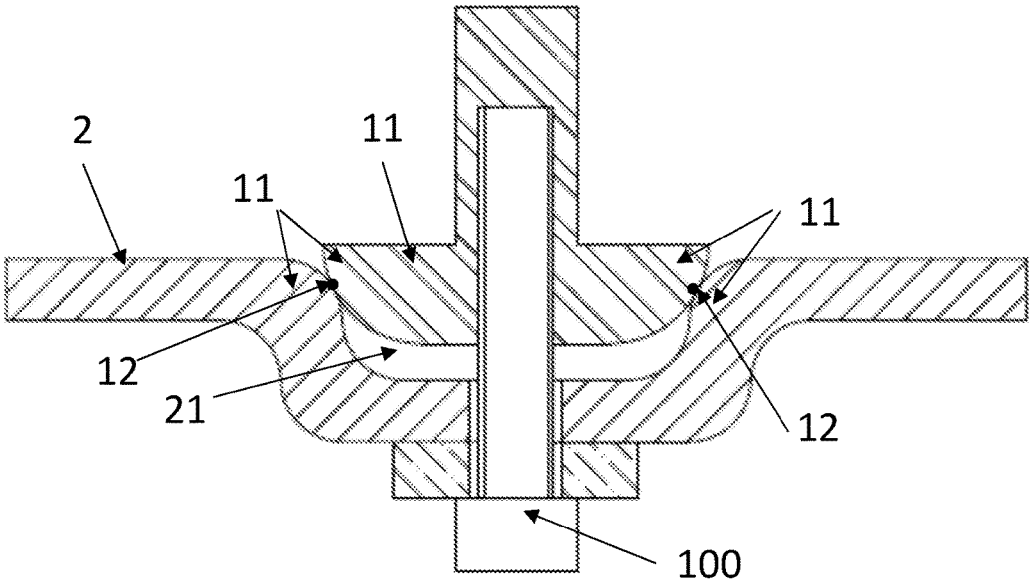
Fig. 2

INTERMODULATION-FREE ELECTRICAL CONTACT FOR HF APPLICATIONS

This application claims priority to Germany Patent Application No. 10 2015 117 687.4, filed Oct. 16, 2015.

FIELD OF THE INVENTION

The invention relates to an arrangement for the intermodulation-free contacting of electrically conductive elements according to the preamble of patent claim 1.

BACKGROUND OF THE INVENTION

In antenna engineering, high demands are placed on the contact between high-frequency elements. One primary problem with contacting is posed by undefined contacts between high-frequency conductors due to the unfavorable design of the contact points. In high-frequency engineering, these undefined contacts lead to undesired passive intermodulation products, abbreviated as PIM, which result from so-called intermodulation. Intermodulation is the parasitic mixing of two different carrier frequencies, which leads to so-called harmonic waves, which are precisely the passive intermodulation products that can result in interference. An unfavorable contact point results, for example, from increased wear at the contact points. Tolerances such as roughness and (un)evenness, as well as clearances in many cases, that result in undefined contacts are a primary reason for undesired intermodulation.

Galvanic contacts between high-frequency components, for example, are contacts between dipole and reflector or other components and reflector, a lid on a housing, or even contacts of high-frequency switches.

Secure galvanic contacts are usually produced by pressing and/or screwing conductive surfaces of two conductors together. Due to the fact that the contact must be permanent and secure, a high force effect is required in order to achieve this. This results in high production cost. What is more, it is problematic that small gaps or recesses can form between the conductors if the surfaces are not completely flat or if one of the surfaces is mounted slightly askew, whereby the electric current and hence the characteristics of the contact can remain undefined, and undesired intermodulation can occur. These tolerances can be compensated for in part by extremely high force during pressing, but that, in turn, results in high production cost and a great amount of energy, and high structural demands are placed on the geometry.

For movable contacts such as high-frequency switches, galvanic contacts are produced by contacting a fixed element by means of two movable conductors, for example. The shape of the fixed element determines the mating shape of the other conductor. Standard contacts are produced by means of level surfaces, as shown in U.S. Pat. No. 6,043,440. Alternatively, a fixed element is shown in U.S. Pat. No. 2,662,142 that has beveled shapes at the points of contact with the conductors. The conductors for switching also have beveled surfaces in order to enable a maximally planar contact to be produced. Another alternative is shown in U.S. Pat. No. 3,226,515. Here, the contact is achieved between the conductors for switching by means of a spherical switch element that can be slid by means of a switch grip mounted on it that establishes the contact between two conductors. This is made possible by disposing a spring element in the switch grip by means of which the switch element can be pressed over the middle conductor, which enables the switch element to establish an electrical contact between the middle and an outer conductor. Advantageously, a spherical switch element and spherical conductors are used here for the contacting, since less force needs to be applied in order to slide the switch element over the middle conductor.

In the known switches, no consideration is given to an intermodulation-free connection or to greater tolerances or unevenness; their aim is merely to achieve sufficient contacting of the conductors.

For the above reasons, it is an object of the present invention to provide an arrangement in which a reproducible, permanently good intermodulation-free electrical contact can be established between high-frequency components and associated contact elements. This object is achieved according to the invention through the features of patent claim 1. Advantageous embodiments are also the subject of the dependent claims.

SUMMARY OF THE INVENTION

What is proposed according to the invention is an arrangement for the electrical contacting of electrically conductive elements, comprising a first element, at least a portion of which is electrically conductive, at least one second element, at least a portion of which is electrically conductive, for electrically contacting the first element, comprising a contact area in at least one end region thereof, with the contact area having a radius at least at predefined contact points that is designed to receive at least a portion of the contact area of the second electrically conductive element such that an electrical contact is formed between the first electrically conductive element and the contact points of the second electrically conductive element.

In another embodiment, the first and the second electrically conductive element are embodied as high-frequency components that are to be contacted with one another. Such components are usually designed as a conductive shielded housing. In another embodiment, the first electrically conductive element is embodied as a high-frequency component and the second electrically conductive element as a contact element that comprises an electrical conductor on whose distal end region the contact area is arranged. In another advantageous embodiment, the first and/or second electrically conductive element is embodied as a reflector plate, a housing, a filter housing, a bias tee, a heat sink, a switch or switch contacts, a dipole or high-frequency conductor.

Through the punctiform contacting of the high-frequency component with the contact element, a uniform and permanent contact and tolerance compensation can be achieved even in case of imprecise assembly. Moreover, substantially less force is required for connecting the components without diminishing the quality of the contact. It is also advantageous that any electrically conductive elements can be electrically contacted with one another—for example, high-frequency components with high-frequency components, high-frequency components with electrical conductors, electrical conductors with other electrical conductors.

Furthermore, a provision is made according to the invention that that the area of the first electrically conductive element for receiving the second electrically conductive element is a recess in the first electrically conductive element. This enables series production of the high-frequency component with integrated recess, which, in turn, results in more convenient production.

Alternatively, the area of the first electrically conductive element for receiving the second electrically conductive element comprises at least two contact legs that are arranged on the first electrically conductive element. It is thus possible to use very thin materials or materials in which the formation of an integrated receptacle is difficult or expensive.

In another advantageous embodiment, the area for receiving the second electrically conductive element comprises three contact legs that are arranged on the first electrically conductive element. This offers the advantage that a three-point support is produced that is very stable but, by virtue of the punctiform contact, allows a large tolerance during assembly nonetheless.

Furthermore, a provision is made according to the invention that that the area of the first electrically conductive element for receiving the second electrically conductive element is a convexity in the first electrically conductive element. This enables series production of the first electrically conductive element with integrated recess, which, in turn, results in more convenient production. In addition, the area between the contact points serves as a support for the first electrically conductive element and thus contributes to the stabilization of the system or arrangement.

Moreover, a provision is made according to the invention that the second electrically conductive element and/or the area of the first electrically conductive element for receiving the second electrically conductive element has beveled edges in predefined contact areas. Alternatively, the area of the first electrically conductive element for receiving the second electrically conductive element has a radius at least in predefined contact areas. Through the provision of beveled edges or a radius, a greater tolerance is allowed during assembly, since the component can also be mounted in an oblique position or slightly tilted without touching the first electrically conductive element elsewhere and thus producing an undesired electrical contact. The area beneath the contact points, i.e., between the contact points and the surface of the second electrically conductive element, is not critical; that is, contact can occur here between the first and second electrically conductive element, since the currents flow only over the surface, i.e., over the contact points to the conductor. In this area, it is important that no other or uneven contacting take place.

An aforedescribed arrangement is also made in relation to the present invention in which the contact element for the electrical contacting of the high-frequency component is set up with a second high-frequency component and the electrical conductor of the contact element has a second contact area at its other distal end, with the second contact area having a radius at least at predefined second contact points, and with the second high-frequency component having at least one area as described previously. This arrangement enables the cascading and multiple contacting of the components.

A provision is also made in relation to the present invention that the arrangement further comprises a fuse element that is arranged in the area of the first electrically conductive element and/or of the second high-frequency component for receiving the second electrically conductive element such that it connects the first electrically conductive element and/or the second high-frequency component to the second electrically conductive element. The fuse element is particularly embodied as a lock screw that is inserted through the underside of the first electrically conductive element and/or of the second high-frequency component into the respective contact areas of the second electrically conductive element.

The lock screw provides additional fixation of the arrangement.

Furthermore, a first element, at least a portion of which is electrically conductive, is provided in relation to the invention having at least one area that is designed to serve as a receiving area for an electrical contact. In another embodiment, a provision is made that the area is a recess in the first element or comprises at least two contact legs that are arranged on the first element or comprises three contact legs that are arranged on the first element or is embodied as a convexity in the first element.

Furthermore, a second element, at least a portion of which is electrically conductive, is provided in relation to the invention comprising a contact area in at least one end region thereof, with the contact area having a radius at least at predefined contact points. In another embodiment, a provision is made that the second electrically conductive element, at least a portion of which is electrically conductive, is embodied as a contact element that comprises an electrical conductor on whose distal end region the contact area is arranged.

In another embodiment, the first and/or the second element are embodied as a reflector plate, a housing or another component such as a filter housing, a bias tee, a heat sink, a switch or switch contacts, a dipole or high-frequency conductor of any kind, and the second element and/or the area of the first element have beveled edges in predefined contact areas or a radius at least in predefined contact areas.

The above-described advantages apply here analogously.

Additional features and advantages of the invention follow from the description of exemplary embodiments of the invention below with reference to the figures of the drawing, which shows details of the invention, and from the claims. The individual features can each be implemented individually or in any combination in a variant of the invention.

BRIEF DESCRIPTION OF THE DRAWINGS

Preferred embodiments of the invention are explained in further detail below with reference to the enclosed drawing.

FIG. 1*a* shows a sectional representation of an arrangement according to one embodiment of the present invention.

FIG. 1*b* shows a possible tolerance compensation through the arrangement shown in FIG. 1*a*.

FIG. 2 shows a sectional representation of an arrangement according to another embodiment of the present invention.

DETAILED DESCRIPTION

In the descriptions of the figures that follow, same elements and functions are designated by the same reference symbols.

Intermodulations occur, for example, in the event of high-powered transmission frequencies that lie close to one another—in transmission equipment in communications technology—and generate undesired interference frequencies. Such parasitic frequencies occur not only in large transmission systems, but also on the interior of the antenna due to poor metal-to-metal junctions or uneven contact surfaces, for example. Uneven contact surfaces are very difficult to avoid, since very high forces must be applied when pressing two surfaces in order to create a solid connection. If the two surfaces that are pressed together are not absolutely flat, it is very likely that the contact between the surfaces will not be uniform over the entire surface. Undesired intermodulations can thus occur. This problem is solved by the arrangement according to the invention.

Figure 6:
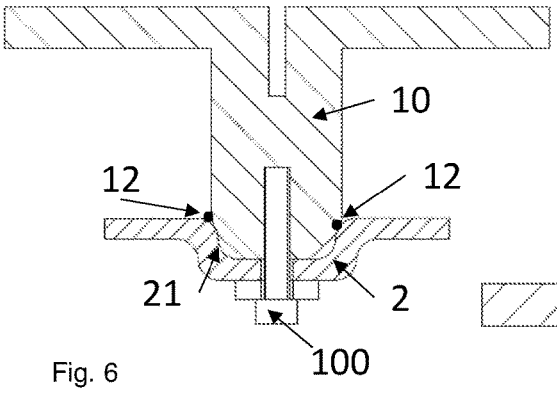
FIG. 6 shows a sectional representation of an arrangement according to another embodiment of the present invention.

The term "high-frequency element" is to be understood as referring to high-frequency components such as reflector plates, a housing or other components such as a filter housing, bias tee, heat sink, switch or switch contacts, dipole, high-frequency conductor of any kind, etc. Possible conductive areas are inner conductors, outer conductors or any type of conductive areas of an element to be contacted, depending on which components are contacted. Examples of different contacts are shown in FIGS. 1*a* and 6. In FIG. 1*a*, a reflector plate is contacted via a contact element with an electrical conductor, with the electrically conductive area in FIG. 6 being an area of a dipole that acts as an electrical conductor.

FIG. 1*a* shows a sectional representation of an arrangement according to one embodiment of the present invention. A first high-frequency element 10 is shown that is embodied as an electrical conductor and that is to be contacted electrically with a second high-frequency element 2 embodied as a high-frequency component such as a reflector plate, a housing or other components such as a filter housing, bias tee, heat sink, switch or switch contacts, dipole, high-frequency conductor of any kind, etc. The high-frequency component 2 has an area 21 that can receive a contact element 1. This area is represented in FIG. 1*a* as a recess in the high-frequency component 2 and has beveled edges. A contact element 1 having an electrical conductor 10 and a contact area 11 can be received in this area 21 of the high-frequency component 2. An electrical contact is thus established between the high-frequency component 2 and the component to be connected through the contact element 1. In FIG. 1, the contact area 11 is depicted as a sphere. Through the spherical geometric shape or a radius at the contact areas 11, it is ensured that the contact areas 11 between the high-frequency component 2 and the contact element 1 form a defined punctiform contact surface. The spherical geometric shape also enables the same contact geometry even with tolerances and positional inaccuracies, so that a permanently good, intermodulation-free electrical contact and very good reproducibility can be ensured without the necessity of applying commensurately high contact forces. In this embodiment, the contact area 11 is shown as a complete sphere. It is sufficient, however, for a spherical geometry or a radius to be provided at the contact area 11 at predefined contact points 12 between high-frequency component 2 and contact area 11 in order to establish a reproducible, permanent, intermodulation-free electrical contact between high-frequency component 2 and contact element 1.

FIG. 1*b* shows such a possible tolerance compensation through the spherical geometry of the contact element 1. The compensation of tolerances and positional inaccuracies is increased through the beveled edges of the high-frequency component 2. By virtue of the funnel-shaped recess 21, the contact element 1 can create an intermodulation-free electrical contact through the punctiform contact surfaces 12 even in a skewed position without establishing an undesired contact with another area of the high-frequency component 2.

Figure 3:
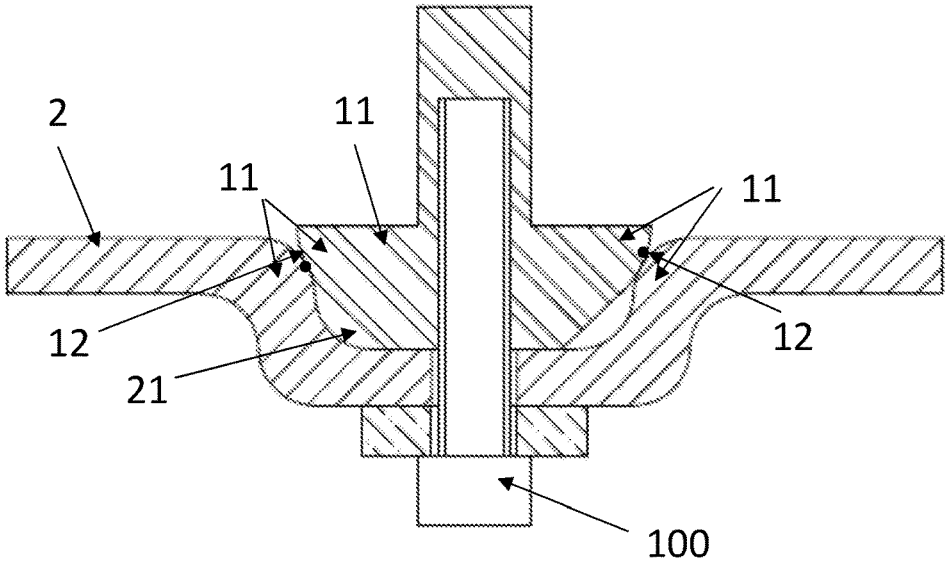
FIG. 3 shows a sectional representation of an arrangement according to another embodiment of the present invention.

FIGS. 2 and 3 each show a sectional representation of an arrangement according to another embodiment of the present invention. Both in FIG. 2 and in FIG. 3, the area 21 of the high-frequency component 2 is embodied as a tub and has rounded edges at the contact points 12. The contact area 11 of the contact element 1, which is embodied as a dipole in both figures, also has a spherical geometry only at the contact points 12 in both figures. This is sufficient for an intermodulation-free contact, since electric currents flow only via the contact points or surfaces. It is thus sufficient to provide the spherical geometry or radius at the contact points 12, whereby positional inaccuracies can be compensated. Since the production of spherical shapes is laborious and expensive, production costs can be reduced by the use of a shape that has a spherical geometry only at the contact points 12 or the use of a radius. In principle, the remaining shape of the contact area 11 can be chosen as desired through the current flow characteristics as long as the contact at the contact points 12 is ensured. Two examples of possible shapes of the contact area 11 within the recess 21 in the high-frequency component 2 are shown in FIGS. 2 and 3. In both figures, a screw 100 is inserted through the underside of the high-frequency component 2 into the contact area 11 of the contact element 1 in order to fasten the contact element 1 to the high-frequency component 2. The screw 100 is used merely to reinforce the fastening of the contact element 1 and can also be replaced by other fastening elements or not be present at all.

In FIG. 2, the contact area 11 is not designed to reach to the bottom of the recess 21. This enables greater tolerance in the manufacture of the recess 21. The screw 100 stabilizes the contact between the high-frequency component 2 and the contact element 1.

In FIG. 3, the contact area 11 of the contact element 1 is designed to reach the bottom of the recess 21, thus resulting in a more stable connection solely by means of the contact element 1. Furthermore, electrical function is separated from mechanical function, and the leverage force of the fastened component is transferred to the block connection while the electrically important contact point 12 remains unstressed, so that attacking forces do not act on the electrical contact point but rather are always diverted to the non-critical mechanical support. In this embodiment, care must be taken to ensure the contact at the contact points. This can be ensured or compensated for slightly by tightly screwing in place with the screw 100.

In the embodiments shown in FIGS. 2 and 3, the contact area 11 is not shown as a complete sphere; rather, it has a spherical geometry or a radius in the contact area 11 at predefined contact points 12 between high-frequency component 2 and contact area 11. However, a complete spherical shape can also be provided as a contact area 11 in order to achieve a reproducible, permanent, intermodulation-free electrical contact between high-frequency component 2 and contact element 1.

Figure 4A:
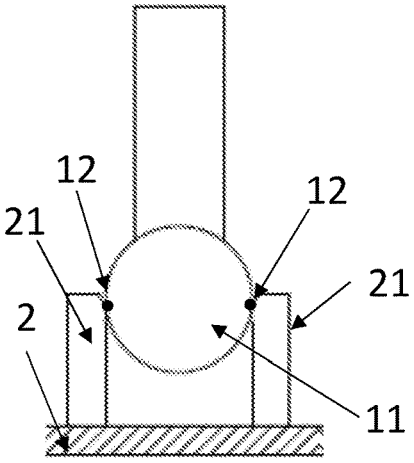
FIG. 4*a* shows a sectional representation of an arrangement according to another embodiment of the present invention.
Figure 4B:
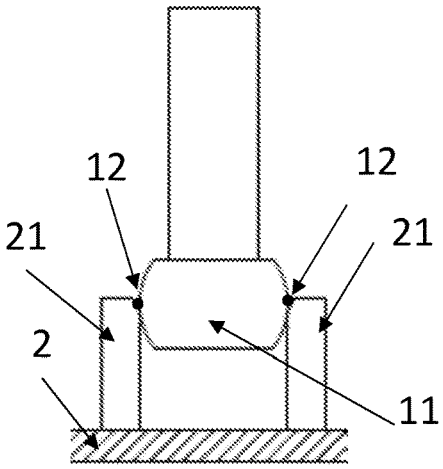
FIG. 4*b* shows a sectional representation of an arrangement according to another embodiment of the present invention.
Figure 4C:
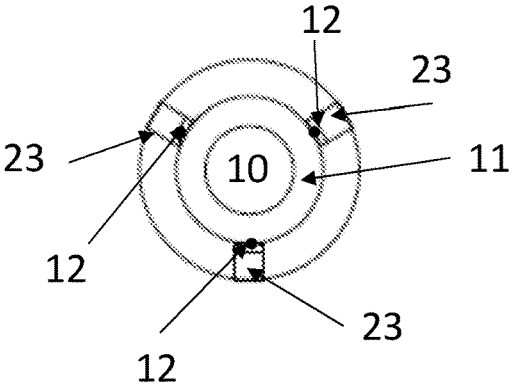
FIG. 4*c* shows a top view of the arrangement shown in FIG. 5*a*.

FIGS. 4*a* and 4*b* each show a sectional representation of an arrangement according to another embodiment of the present invention. FIG. 4*a* shows the same contact element 1 as in FIG. 1*a*. FIG. 4*b* shows an alternative shape of a contact area 11 that has a spherical geometry or a radius only at defined contact points 12. Both types of shape of the contact area 11 are suitable for creating intermodulation-free contact between high-frequency component 2 and contact element 1. Unlike the embodiment shown in FIG. 1*a*, the contact area 21 of the high-frequency component 2 is not embodied in FIGS. 4*a* and 4*b* as a recess in the high-frequency component 2, but rather as contact legs on the high-frequency component 2. This offers the advantage that no elaborate etching processes or other processes need to be used in order to produce recesses in the high-frequency component 2. Moreover, very thin sheets or other suitable materials can thus also be used as the high-frequency component 2, e.g., reflector plates. The use of three contact legs 21 as shown in FIG. 4*c* is especially advantageous, since a very high level of stability is achieved by the three-point support while still enabling a very good compensation of positional inaccuracies nonetheless.

Figure 5:
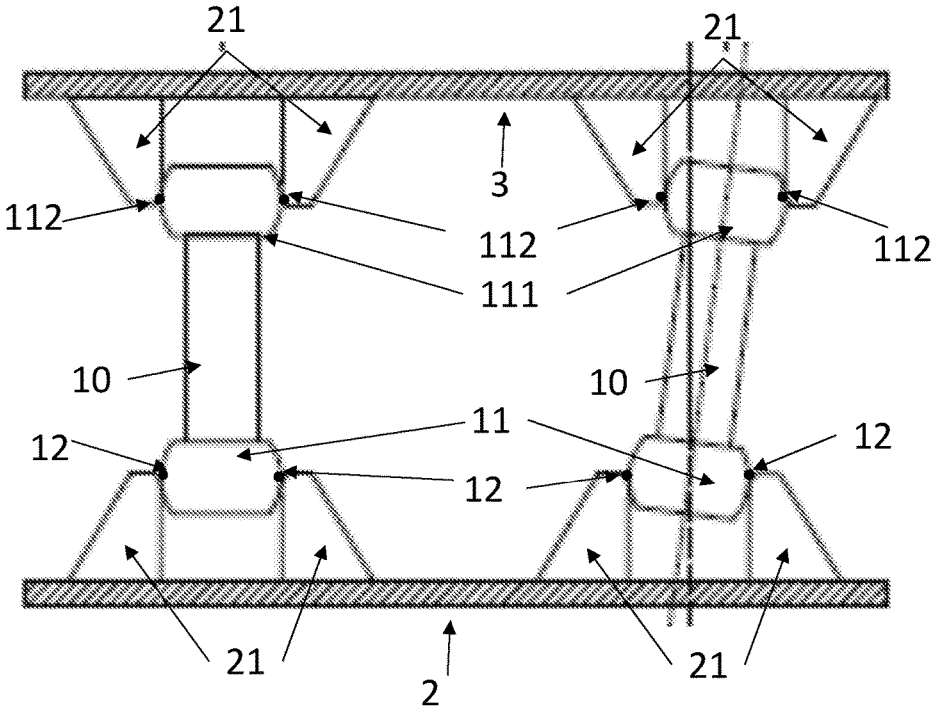
FIG. 5 shows a sectional representation of an arrangement according to another embodiment of the present invention.

FIG. 5 shows a sectional representation of an arrangement according to another embodiment of the present invention. A so-called cascade is shown in this embodiment. This means that two high-frequency components 2 and 3 are interconnected via the same contact element 1. The contact element 1 therefore has contact areas 11 and 111 at both distal ends. Like in the previously described embodiments, these contact areas 11 and 111 are shaped such that they have a radius or a spherical geometry at least at predefined contact points 12 and 112. It is not necessary for the two contact areas 11 and 111 to have the same shape, which can be advantageous from a technical production standpoint. The advantage of the spherical geometry present at least at the contact points 12 and 112 can be seen here very clearly. When positional inaccuracies are present, the inaccuracy can be compensated by rotating or tilting one of the contact elements 1 without losing the defined contact between high-frequency component 2 and contact element 1.

As with all of the previously described embodiments, in this embodiment, the area of the high-frequency component 2 for receiving the contact area 11 of the contact element 1 can both be a recess in the high-frequency component 2 and embodied as contact legs on the high-frequency component 2 as described previously. The contact area 11 of the contact element 1 can also be embodied as a complete sphere or have a spherical geometry or a radius only at predefined contact points 12. This means that any desired combination of the area 21 of the high-frequency component 2 for receiving the contact area 11 of the contact element 1 and shape of the contact area 11 of the contact element 1 results in the creation of a reproducible, permanent, intermodulation-free electrical contact.

Figure 7:
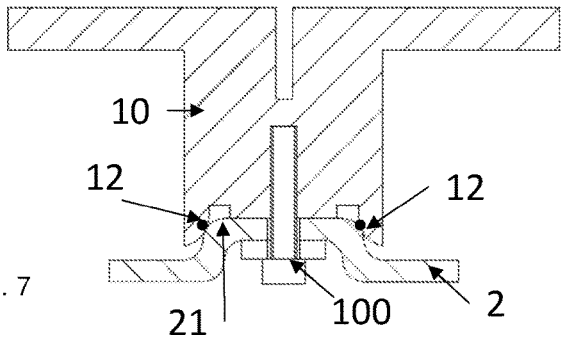
FIG. 7 shows a sectional representation of an arrangement according to another embodiment of the present invention.

FIGS. 6 and 7 each show a sectional representation of an arrangement according to different embodiments of the invention, with a dipole 10 being arranged for the sake of example on a reflector plate 2 as the high-frequency component to be contacted. Like in the example described in FIG. 3, for example, the area 21 of the high-frequency component—here of the reflector plate 2—is embodied as a tub, and in FIG. 7 as an inverted tub or convexity, and has rounded edges at the contact points 12. The contact area 11 of the contact element 1 also has a spherical geometry only at the contact points 12 in both figures. This is sufficient for an intermodulation-free contact, since electric currents flow only via the contact points or surfaces. It is thus sufficient to provide the spherical geometry or radius at the contact points 12, whereby positional inaccuracies can be compensated. Since the production of spherical shapes is laborious and expensive, production costs can be reduced by the use of a shape that has a spherical geometry only at the contact points 12 or the use of a radius. In principle, the remaining shape of the contact area 11 can be chosen as desired through the current flow characteristics as long as the contact at the contact points 12 is ensured.

FIG. 6 shows an example of a possible shape of the contact area 11 within the recess 21 in the reflector plate 2. Like in FIG. 3, the contact area 11 of the contact element 1 is designed to reach to the bottom of the recess here, thus resulting in the same advantages as described above.

FIG. 7 shows an alternative embodiment of the area 21 of the high-frequency component, here of the reflector plate 2 for receiving the dipole 10. The area 21 is embodied here as a convexity on which the dipole 10 is placed for contacting. Here, too, only the rounded edges of the dipole 10 and of the area 21 of the reflector plate 2 are used for the electrical contact; that is, the electrical contact occurs here only at the contact points 12, as explained in relation to the exemplary embodiments shown above. In order to fasten the dipole 10 stably, it can rest on the convexity between the contact points 12 and be additionally fastened to the reflector plate 2 with another fastening means.

In both figures, a screw 100 is inserted through the underside of the reflector plate 2 into the contact area 11 of the contact element 1 in order to fasten the contact element 1. The screw is used merely to reinforce the fastening of the contact element 1 and can also be replaced by other fastening elements or not be present at all.

LIST OF REFERENCE SYMBOLS

1 contact element
2 high-frequency component
3 second high-frequency component
10 electrical conductor
11 contact area
111 second contact area
12 contact points
112 second contact points
21 area of the high-frequency component for receiving the contact element
23 contact legs
100 screw

What is claimed is:

1. An arrangement for electrical intermodulation-free contacting electrically conductive elements (2, 1), comprising:

a first element (2), at least a portion of which is electrically conductive;

at least one second element (1), at least one portion (10) of which is electrically conductive, for electrically contacting the first element (2), comprising a contact area (11) in at least one end region thereof, wherein the contact area (11) has a radius at least at predefined contact points (12), wherein the first electrically conductive element (2) has at least one area (21) that is designed to receive at least a portion of the contact area (11) of the second electrically conductive element (1) such that an electrical contact is created between the first electrically conductive element (2) and the contact points (12) of the second electrically conductive element (1), and wherein the first electrically conductive element (2) is embodied as a high-frequency component (2) and the second electrically conductive element (1) as a contact element (1) that comprises an electrical conductor (10) on whose distal end region the contact area (11) is arranged.

2. The arrangement of claim 1, wherein the first and/or second electrically conductive element (1, 2) is embodied as a reflector plate, a housing, a filter housing, a bias tee, a heat sink, a switch or switch contacts, a dipole or high-frequency conductor.

3. The arrangement of claim 1, wherein the area (21) of the first electrically conductive element (2) for receiving the second electrically conductive element (1) is a recess in the first electrically conductive element (2).

4. The arrangement of claim 1, wherein the area (21) of the first electrically conductive element (2) for receiving the second electrically conductive element (1) comprises at least two contact legs (21) that are arranged on the first electrically conductive element (2).

5. The arrangement of claim 4, wherein the area (21) for receiving the second electrically conductive element (1) comprises three contact legs (23) that are arranged on the first electrically conductive element (2).

6. The arrangement of claim 1, wherein the area (21) of the first electrically conductive element (2) for receiving the second electrically conductive element (1) is a convexity in the first electrically conductive element (2).

7. The arrangement of claim 1, wherein the second electrically conductive element (1) and/or the area (21) of the first electrically conductive element (2) for receiving the second electrically conductive element (1) has beveled edges in predefined contact areas (11).

8. The arrangement of claim 1, wherein the second electrically conductive element (1) and/or the area (21) of the first electrically conductive element (2) for receiving the second electrically conductive element (1) has a radius at least in predefined contact areas (11).

9. The arrangement of claim 1, wherein the contact element (1) is set up for electrically contacting the high-frequency component (2) with a second high-frequency component (3), and the electrical conductor (10) of the contact element (1) has a second contact area (111) at its other distal end, wherein the second contact area (11) has a radius at least at predefined second contact points (112).

10. The arrangement of claim 1, further comprising a fuse element (100) that is arranged in the area (21) of the first electrically conductive element (2) and/or of the second high-frequency component (3) for receiving the second electrically conductive element (1) such that it connects the first electrically conductive element (2) and/or the second high-frequency component (3) to the second electrically conductive element (1), with the fuse element (100) being embodied particularly as a lock screw that is inserted through the underside of the first electrically conductive element (2) and/or of the second high-frequency component (3) into the respective contact areas (11, 111) of the second electrically conductive element (1).

* * * * *